US005992317A

United States Patent [19]

Hummel et al.

[11] Patent Number: 5,992,317

[45] Date of Patent: Nov. 30, 1999

[54] DAMPENING UNIT FOR AN OFFSET PRINTING MACHINE

[75] Inventors: Peter Hummel, Offenbach; Robert Ortner, Alzenau; Rudolf Raab, Hanau, all of Germany

[73] Assignee: Man Roland Druckmaschinen AG, Germany

[21] Appl. No.: 09/061,649

[22] Filed: Apr. 17, 1998

[30] Foreign Application Priority Data

Apr. 17, 1997 [DE] Germany ..... 297 06 932 U

[51] Int. Cl.[6] ..... B41L 25/00

[52] U.S. Cl. ..... 101/148

[58] Field of Search ..... 101/148

[56] References Cited

U.S. PATENT DOCUMENTS

| | | | |
|---|---|---|---|
| 3,613,575 | 10/1971 | Kantor | 101/148 |
| 3,926,116 | 12/1975 | Wildeman | 101/148 |
| 4,287,827 | 9/1981 | Warner | 101/148 |
| 4,724,764 | 2/1988 | MacPhee et al. | 101/148 |
| 5,025,724 | 6/1991 | Holl et al. | 101/148 |

FOREIGN PATENT DOCUMENTS

| | | |
|---|---|---|
| 0 761 432 A1 | 7/1996 | European Pat. Off. . |
| 30 16 366 | 12/1980 | Germany . |
| 34 16 845 A1 | 11/1984 | Germany . |
| 33 34 470 A1 | 4/1985 | Germany . |
| 34 32 807 A1 | 6/1985 | Germany . |
| 39 08 043 C1 | 4/1990 | Germany . |
| 39 23 636 C2 | 5/1996 | Germany . |
| 195 29204 A1 | 2/1997 | Germany . |
| 195 29205 A1 | 2/1997 | Germany . |

OTHER PUBLICATIONS

Der wasserlose Offsetdruck (Trockenflachdruck), *Offset Druck* Polygraph Handbuch, Wolfgang Walenski Chapter 33, pp. 217,218.

*Primary Examiner*—Edgar Burr
*Assistant Examiner*—Amanda B. Sandusky
*Attorney, Agent, or Firm*—Leydig, Voit & Mayer, Ltd.

[57] ABSTRACT

An offset printing machine having a plate cylinder which carries a printing form and which is operatively connected to an inking unit and a dampening unit is provided. The dampening unit includes a dampening applicator roller which is mounted in contacting relation with the dampening applicator roller. The dampening applicator roller also includes at least one auxiliary roller which is mounted in contacting relation with the dampening applicator roller downstream or after the contact point between the dampening applicator roller and the plate cylinder. The auxiliary roller has a surface with a coating of non-stick material which blocks the transfer of ink and dampening medium to the surface of the auxiliary roller and is axially movable relative to the dampening applicator roller and selectively rotatable at circumferential speeds substantially equal to or different from the circumferential speed of the dampening applicator roller.

10 Claims, 1 Drawing Sheet

DAMPENING UNIT FOR AN OFFSET PRINTING MACHINE

FIELD OF THE INVENTION

The present invention relates generally to dampening units for offset printing machines, and more particularly, to dampening units that are operatively connected between an inking unit and a plate cylinder which carries a printing form.

BACKGROUND OF THE INVENTION

A dampening unit of this type is known from DE 34 16 845 Al. In this reference, a dampening unit generally includes a feed device for the dampening medium, a device for metering the dampening medium film and an applicator roller which transfers the dampening medium film onto a plate cylinder and which can be coupled to an adjacent inking unit or operated separately. The dampening applicator roller can be operated at a different circumferential speed than the plate cylinder, so that a resulting wiping effect eliminates foreign particles.

German patent publication DE 34 32 807 Al, in conjunction with U.S. Pat. No. 4,724,764, discloses a more refined dampening unit. In addition to selectively operating the plate cylinder and dampening applicator roller at different circumferential speeds, an ink receiving roller, called a rider roller, is provided for the dampening applicator roller. In this case, the ink-receiving roller rotates at a circumferential speed different from the plate cylinder and can be coupled to an adjacent inking unit or be operated separately.

A disadvantage of the foregoing prior art dampening units is that ink accumulating on the dampening applicator roller is carried into the dampening unit and consequently the ink/dampening medium equilibrium can become impaired. These impairments can take the form of ghosting (shadow-like markings) or streaking which cause uneven printing.

A dampening applicator roller in a dampening unit is also disclosed in DE 30 16 366 Al. In particular, this dampening unit includes a metered-feed applicator roller, that acts as metering device and is arranged upstream of the point of contact of the dampening applicator rollers with the plate cylinder. The dampening unit also includes an oscillating cylinder having a hydrophilic surface which is arranged downstream of the contact point of the dampening applicator rollers and the plate cylinder.

DE 195 29 204 Al discloses yet another dampening unit for an offset printing machine. The disclosed dampening unit includes a dampening applicator roller which is movable into and out of contacting relation with the plate cylinder. Additionally, a dampening medium feed device is arranged upstream of and in contact with the dampening applicator roller in the direction of rotation and a roller that accepts dampening medium is arranged, as a rider roller, downstream of the dampening applicator roller. Further, an ink-carrying rider roller is arranged downstream of the rider roller and also is in contacting relation with the dampening applicator roller.

OBJECTS AND SUMMARY OF THE INVENTION

Accordingly, in view of the foregoing it is an object of the invention to provide an improved dampening unit for an offset printing machine which is adapted for effecting a more uniform, fault-free feed of dampening medium to the plate cylinder particularly during the processing of printing inks having metallic pigment components.

A related object of the present invention is to provide a dampening unit as characterized above which provides improved print quality and prevents a dampening applicator roller from transferring contours from the printing subject to the plate cylinder.

These objects are carried out in a dampening unit having at least one dampening applicator roller and at least one auxiliary or rider roller that accepts neither dampening medium nor printing ink. The auxiliary or rider roller is mounted in contacting relation with the dampening applicator roller downstream from or after the contact point of the dampening applicator roller and plate cylinder relative to the rotational direction of the dampening applicator roller. In a preferred embodiment, a second auxiliary roller may be provided adjacent to and downstream of or after the contact point between the first auxiliary roller and the dampening applicator roller. The second auxiliary roller is also mounted in contacting relation with the dampening applicator roller. The first auxiliary roller and, if appropriate, the second auxiliary roller may be provided with a non-stick surface coating which repels both ink and dampening medium. Additionally, at least one of the auxiliary rollers is provided with a transverse drive which is capable of moving the roller axially relative to the dampening applicator roller and rotating the auxiliary roller at a circumferential speed equal to or different from the circumferential speed of the dampening applicator roller.

During operation of the printing machine, a structure of dampening medium and ink tends to build up on the outer surface of the dampening applicator roller downstream from the contact point of the dampening applicator roller and the plate cylinder. If this dampening medium and ink structure is not completely leveled, it will lead to an unwanted transfer of contours to the printing form that is fixed to the plate cylinder. The non-stick surface coating on the auxiliary roller, in conjunction with axial movement and rotation of the auxiliary roller at the appropriate circumferential speed, breaks down or levels the ink and dampening medium structure on the dampening applicator roller thereby noticeably reducing the transfer of contours, the tendency to ghosting with large-area printing, as well as the stripes which lead to a non-uniform print. It has also been found that in a dampening unit of the present invention, the dampening medium feed from the dampening medium duct roller can be reduced, the use of alcohol can be reduced and the dampening as a whole becomes more stable as a result of a reduction in disturbance variables. The roller arrangement also ensures that the ink/dampening medium equilibrium is reached rapidly, while consistently producing a very thin dampening film in conjunction with the metering device.

These and other features and advantages of the invention will be more readily apparent upon reading the following description of a preferred exemplary embodiment of the invention and upon reference to the accompanying drawing wherein:

Figure 1:
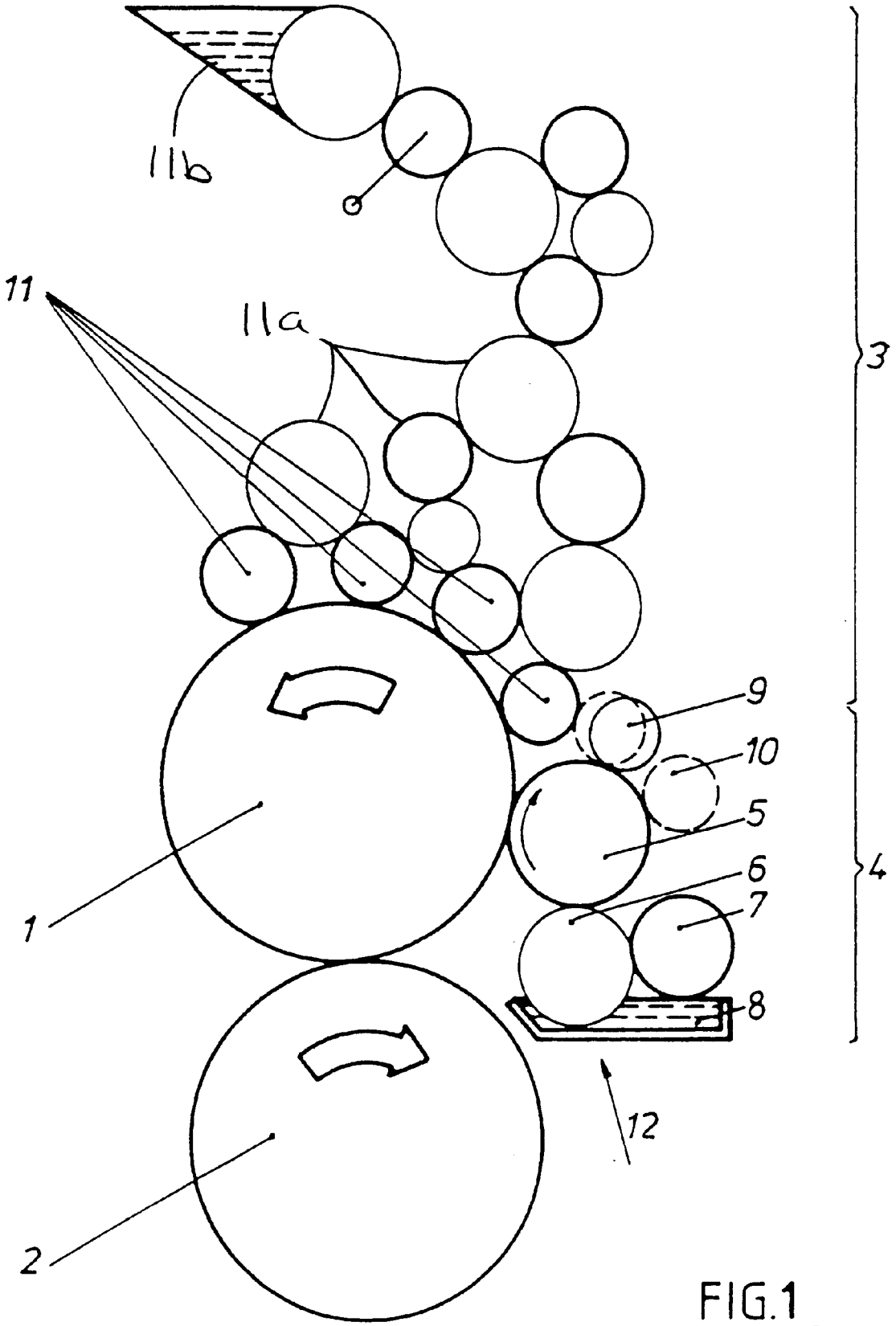
FIG. 1 is a diagrammatic depiction of a printing unit for wet offset printing having a dampening unit in accordance with the present invention.

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF A PREFERRED EMBODIMENT

Referring now more particularly to FIG. 1 there is shown a rotatable plate cylinder 1 operatively connected to a dampening unit 4 in accordance with the present invention. For supplying ink to the plate cylinder 1, an inking unit 3 is provided which comprises a plurality of ink applicator rollers 11 connected to ink feeding rollers 11*a* and ink supply 11*b* in a conventional manner. The ink applicator rollers 11 are disposed in contacting relation with the plate cylinder 1 at circumferentially spaced intervals about the perimeter of the plate cylinder 1, and preferably may be adapted for throw-on and throw-off movement. In the illustrated embodiment, a blanket cylinder 2 is also provided in contacting relation with the plate cylinder 1.

For supplying dampening medium to the plate cylinder 1, the dampening unit 4 includes a dampening applicator roller 5 disposed in contacting relation with the plate cylinder 1 at a point upstream from or in front of the inking unit 3 relative to the rotational direction of the plate cylinder 1. For supplying dampening medium to the dampening applicator roller 5, the dampening unit 4 also includes a dampening medium feed device 12 which comprises a dampening medium container 8, a dampening medium duct roller 6 in contacting relation with and disposed within the dampening medium container, and a dampening medium metering roller 7 in contacting relation with the duct roller 6 for creating a thin dampening medium film on the duct roller for transfer to the dampening applicator roller 5. As illustrated in FIG. 1, the duct roller 6 is rotatably positioned so that it is partially immersed in the dampening medium container 8. While the present invention is described in connection with a dampening unit which employs a single dampening applicator roller, it will be readily appreciated that it is also applicable to dampening units which have more than one dampening applicator roller.

In accordance with an important aspect of the present invention, at least one auxiliary roller is arranged in contacting relation with the dampening applicator roller downstream from or after the contact point of the dampening applicator roller 5 and the plate cylinder 1 in order to break down the structure of dampening medium and ink which builds-up on the dampening applicator roller. As will be appreciated by those skilled in the art, a structure of dampening medium and ink builds up on the outer surface of the dampening applicator roller 5 downstream of the contact point of the dampening applicator roller 5 and the plate cylinder 1. If this structure is not properly leveled or broken down, it can result in an unwanted transfer of contours to the printing form which is attached to the plate cylinder 1. For effecting the break down or leveling of this structure, in the illustrated embodiment, a first auxiliary roller 9 in the form of a rider roller is provided downstream of or after the dampening applicator roller 5 (relative to the rotational direction of the dampening applicator roller).

In accordance with a further aspect of the invention, the circumferential surface of the first auxiliary roller 9 is provided with a non-stick coating which enables the first auxiliary roller 9 to block the transfer of both dampening medium and printing ink to its surface. In one preferred embodiment, the non-stick coating consists of a material which includes a fluorine-containing polymer, and more particularly, at least some proportion of polytetrafluoroethylene (PTFE). Additionally, the non-stick coating on the circumferential surface of the first auxiliary roller 9 preferably has a slightly rough surface such as, for example, a surface roughness of approximately 5 to 50 $\mu$m.

In order to couple the damping unit 4 to the inking unit 3 for the purpose of washing the ink applicator rollers 11, the first auxiliary roller 9 is also operable as a bridge roller. In particular, the first auxiliary roller 9 is selectively movable into contacting relation with the inking unit 3. In the illustrated embodiment, the auxiliary roller 9 is movable into contacting relation (shown in broken lines in FIG. 1) with the first ink applicator roller 11 of the inking unit 3. It will be understood that such movement may be effected by an appropriate reciprocating mechanism.

The first auxiliary roller 9 has a drive which can rotate the auxiliary roller 9 at a circumferential speed equal to or different from either the circumferential speed of the plate cylinder 1 or the circumferential speed of the dampening applicator roller 5. The auxiliary roller 9 also preferably has a transverse drive of a known type for moving the roller 9 axially relative to the dampening applicator roller 5.

In carrying out a further aspect of the invention, a second auxiliary roller 10 may be provided in contacting relation with the dampening applicator roller 5 downstream of or after the first auxiliary roller 9 relative to the rotational direction of the dampening applicator roller 5. As with the first auxiliary roller 9, the circumferential surface of the second auxiliary roller 10 can be provided with a non-stick coating which includes polytetrafluoroethylene (PTFE) and which has a surface roughness of approximately 5 to 50 $\mu$m. In addition, the second auxiliary roller 10 can also have a drive which can rotate the second auxiliary roller at a circumferential speed equal to or different from the circumferential speed of the dampening applicator roller 5.

In the printing mode of operation of the printing machine, the first auxiliary roller 9 can be uncoupled from the inking unit 3 or integrated into the inking unit 3 and operated as a bridging roller as shown in broken lines in FIG. 1. Depending on the printing requirements, a structure of dampening medium and ink is formed on the dampening applicator roller 5 downstream of the contact point of the dampening applicator roller 5 and plate cylinder 1. This structure is broken down or leveled through operating one or both of the auxiliary rollers 9, 10 in contacting relation with the dampening applicator roller 5. Since both the auxiliary rollers 9, 10 have a non-stick coating on their respective circumferential surfaces, neither of the auxiliary rollers 9, 10 receives printing ink or dampening medium from the dampening applicator roller 5. Accordingly, unlike prior art arrangements neither printing ink nor dampening medium is "stored" temporarily on the rollers 9, 10. However, as a result of the axial oscillation and/or rotation of one or both of the auxiliary rollers 9, 10 at a circumferential speed equal to or different from the circumferential speed of the dampening applicator roller 5, the rollers 9, 10 break down the ink/dampening medium mixture or structure on the surface of the dampening applicator roller 5. Once this structure has been broken down, the surface of the dampening applicator roller 5 is once again prepared to receive dampening medium from the dampening medium feed device 12.

While this invention has been described with an emphasis upon preferred embodiments, it will be obvious to those of ordinary skill in the art that variations of the preferred embodiments may be used and that it is intended that the invention may be practiced otherwise than as specifically described herein. Accordingly, this invention includes all modifications encompassed within the spirit and the scope of the invention as defined by the following claims.

What is claimed is:

1. An offset printing machine comprising a plate cylinder having a printing form, an inking unit having at least one rotatable ink applicator roller for transferring ink to the plate cylinder, a dampening unit having at least one rotatable dampening applicator roller in contacting relation to the plate cylinder for transferring a dampening medium to the plate cylinder at a predetermined contact point, a dampening medium feed device for supplying dampening medium to the dampening applicator roller at a contact point in front of the contact point of the said dampening applicator roller with the plate cylinder in the direction of rotation of the dampening applicator roller, and at least one auxiliary roller in contact with the dampening applicator roller after the contact point between the dampening applicator roller and the plate cylinder, and said auxiliary roller having a surface with a coating of non-stick material which blocks and prevents the transfer of ink and dampening medium from the surface of the dampening applicator roller to the surface of the auxiliary roller.

2. The offset printing machine according to claim 1 further comprising a second auxiliary roller mounted in contact with the dampening applicator roller after the contact point of the first auxiliary roller with the dampening applicator roller, the second auxiliary roller having a surface made of a non-stick material which blocks the transfer of ink and dampening medium to the surface of the second auxiliary roller.

3. The offset printing machine according to claim 1 including a drive for rotating the at least one auxiliary roller at a circumferential speed which is equal to the circumferential speed of the plate cylinder.

4. The offset printing machine according to claim 1 including a drive for rotating the at least one auxiliary roller at circumferential speeds different from the circumferential speed of the plate cylinder.

5. The offset printing machine according to claim 1 wherein the non-stick coating on the surface of the at least one auxiliary roller contains a fluorine-containing polymer.

6. The offset printing machine according to claim 2 wherein the non-stick coating on the surface of the second auxiliary roller contains a fluorine-containing polymer.

7. The offset printing machine according to claim 5 wherein the non-stick coating on the surface of the at least one auxiliary roller contains polytetrafluoroethylene.

8. The offset printing machine according to claim 6 wherein the non-stick coating on the surface of the second auxiliary roller contains polytetrafluoroethylene.

9. The offset printing machine according to claim 1 including a drive for axially moving the auxiliary roller relative to the dampening application roller.

10. The offset printing machine according to claim 1 in which said auxiliary roller is movable from a first operative position in contacting relation with the dampening applicator roller and a second operative position in operative engagement with both the dampening applicator roller and an ink applicating roller.

* * * * *